US005199405A

United States Patent [19]

Mukaihira et al.

[11] Patent Number: 5,199,405

[45] Date of Patent: Apr. 6, 1993

[54] IGNITION CURRENT CONDUCTION TIME CONTROL APPARATUS FOR INTERNAL COMBUSTION ENGINE

[75] Inventors: Takashi Mukaihira, Katsuta; Noboru Sugiura, Mito; Ryoichi Kobayashi, Ibaraki; Toshio Ishii, Mito, all of Japan

[73] Assignee: Hitachi, Ltd., Tokyo, Japan

[21] Appl. No.: 697,599

[22] Filed: May 9, 1991

[30] Foreign Application Priority Data

May 18, 1990 [JP] Japan ..... 2-126990

[51] Int. Cl.[5] ..... F02P 3/045

[52] U.S. Cl. ..... 123/609; 123/644

[58] Field of Search ..... 123/609, 644

[56] References Cited

U.S. PATENT DOCUMENTS 4,285,323 8/1981 Sugiura et al. ..... 123/609 X 4,711,226 12/1987 Neuhalfen et al. ..... 123/609

FOREIGN PATENT DOCUMENTS 197470 11/1983 Japan .

135869 8/1987 Japan .

*Primary Examiner*—Tony M. Argenbright

*Attorney, Agent, or Firm*—Antonelli, Terry, Stout & Kraus

[57] ABSTRACT

An ignition current conduction time control apparatus, comprising power transistors for producing a spark for ignition at the ignition plugs, and a controller for applying ignition signals to the power transistors, wherein the saturated state of the power transistors is eliminated by controlling the start time of current conduction time of said ignition signals applied to the power transistors according to the internal resistance values of the ignition coils, thereby eliminating the heat generation of the ignition coils.

10 Claims, 7 Drawing Sheets

IGNITION CURRENT CONDUCTION TIME CONTROL APPARATUS FOR INTERNAL COMBUSTION ENGINE

BACKGROUND OF THE INVENTION

This invention relates to an ignition current conduction time control apparatus for an internal combustion engine.

Various techniques for separately controlling current applied to the ignition coils of the individual cylinders of an internal combustion engine are disclosed in JP-A-58-197470 and Japanese Utility Model Application Laid-Open No. 62-135869. JP-A-58-197470 proposes a technique for determining the crank angle when the cylinder pressure is maximum for each cylinder, and controlling ignition timing so that the crank angle values are the same for all cylinders. Japanese Utility Model Application Laid-Open No. 62-135869 discloses a technique for controlling the start and the end of current conduction to the primary side of the ignition coil for each cylinder according to the characteristics of the cylinders.

In both JP-A-58-197470 and Japanese Utility Model Application Laid-Open No. 62-135869, a current is applied to the ignition coil for the individual cylinders, but no consideration is given to the variation in the characteristics of the ignition coils for the individual cylinders.

In ignition control at high engine speed (more, than 6000 rpm, for example), it is necessary to cause the operational current applied to the ignition coils to rise sharply. This rise is determined by a circuit time constant (R/L). R denotes the resistance component of the internal resistance, of the coil, for example, and L denotes the inductance component of the coil. Therefore, in order to achieve a sharp rise in the current, it is necessary to provide a small R and a large L. However, this time constant (R/L) varies with the cylinders, and as a result, it is impossible to provide for a uniform rise of the current applied to the ignition coils for the individual cylinders.

The variation in the circuit time constants (R/L) chiefly results from the quality irregularity in the manufacture of the parts of the ignition coils. In addition, the circuit time constant sometimes varies as the resistance component R changes with a change in temperature. The reference voltage to the collector of the power transistor for control of the operating current to each ignition coil is supplied from a power source (a battery or a generator). If this source voltage changes, the I component in the energy $LI^2$ accumulated in the ignition coil changes, causing the ignition energy to change, which results in an uncalled-for phenomenon.

The above-mentioned two prior-art techniques give no consideration to the control of current conduction time when there are variations in the inductance L and the resistance R of the ignition coils and when there are changes in the operating conditions, including the ambient temperature, the source voltage, etc., nor do the publications provide any description of a method of reducing the current conduction time when it becomes excessive. For example, a problem resulting from an excessive current conduction time is that when the current conduction time is long, the amount of generated heat of the primary coil increases, which is another uncalled-for phenomenon.

SUMMARY OF THE INVENTION

An object of this invention is to provide an ignition current conduction time control apparatus for an internal combustion engine for optimizing the ignition timing for each cylinder in consideration of changes in the operating conditions, including the characteristic variation in the parts of the ignition system, such as the ignition coils, and the environmental conditions, such as the ambient temperature.

Another object of this invention is to provide an ignition current conduction control apparatus for an internal combustion engine for performing the shortest current conduction to suit the cylinders.

This invention controls the operational current of each cylinder in consideration of changes in the operating conditions, including variations in the parts of the ignition system, such as the ignition coils.

In addition, this invention detects a saturated state of the power transistor which supplies the ignition energy to the ignition coil, and reduces the current conduction time when supplying a current to the ignition coil so as to prevent the power transistor from assuming the saturated state.

Moreover, in reducing this current conduction time, this invention finds an excess time length in excess of a standard current conduction time, and in the subsequent ignition cycle, has the current conduction time reduced by a length proportional to the excess current conduction time length.

DESCRIPTION OF THE PREFERRED EMBODIMENTS

Figure 1:
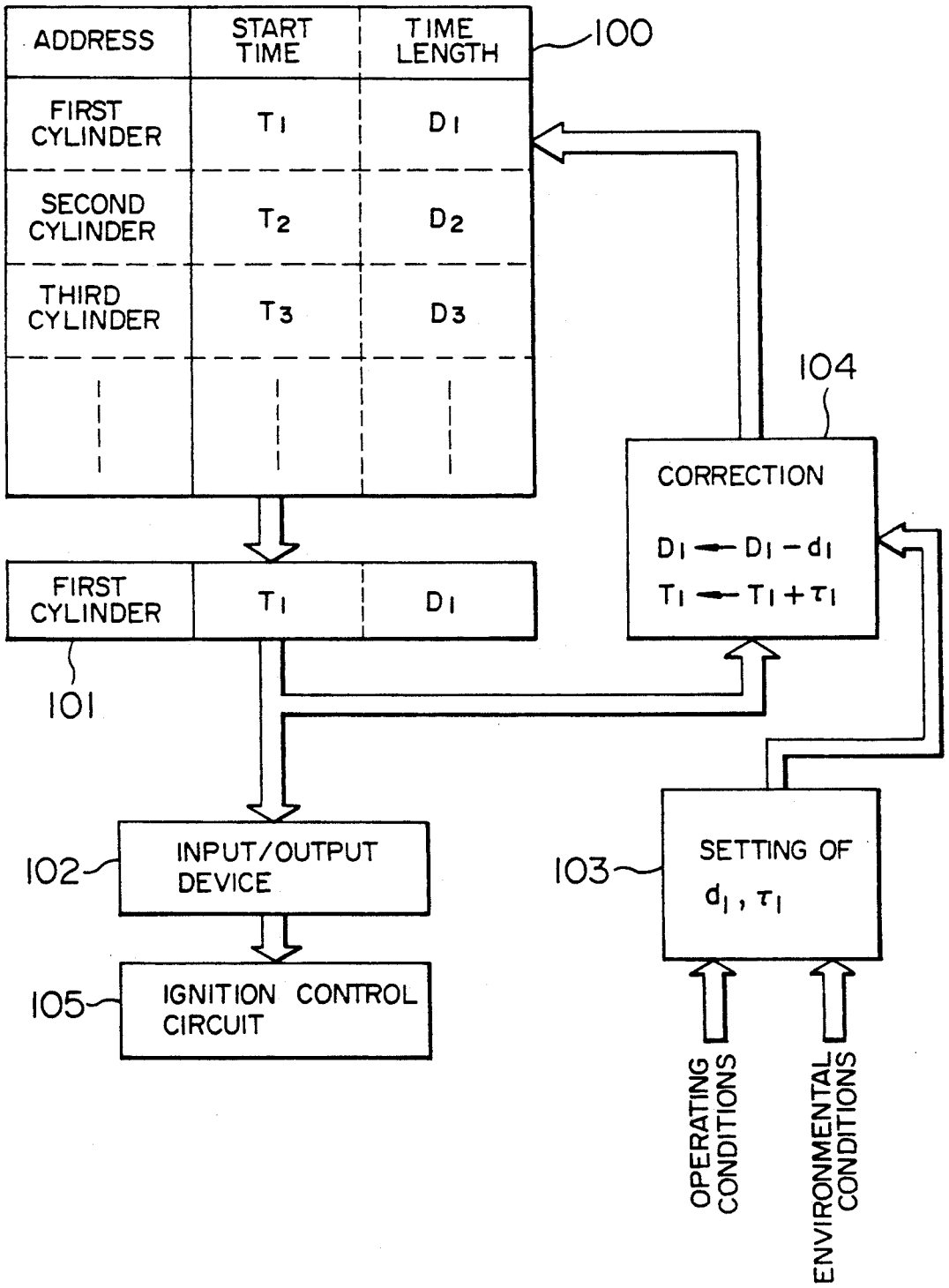
FIG. 1 is a diagram showing the composition of a table in an ignition current conduction time control apparatus according to an embodiment of this invention.

FIG. 1 is a diagram showing an embodiment of this invention. A table 100 stores ignition command signals IGN at cylinder addresses. Suppose that the ignition system is structured on a one-plug-to-one-cylinder correspondence. An ignition command signal IGN is an ignition advance signal derived from basic ignition advance characteristics determined by a reference signal REF, obtained from the crankshaft rotation, and an intake air quantity Q. To be more specific, an ignition command signal IGN consists of a time (start time) $T_i$ until this ignition, command signal IGN is generated and a time duration. $D_i$ during which the ignition command signal IGN continues to be present from the start time. The basic ignition advance characteristics are corrected by the engine temperature (high or low temperature). The basic ignition advance characteristics after this correction may be used. The ignition command signal IGN is a signal to specify an ON time length in which the power transistor, located at the preceding stage to that of the ignition coil, is turned ON. Seen from the ignition coil, this signal may be regarded as a signal to give a current conduction time for storing energy in the ignition coil. Seen from a different viewpoint, the signal may be regarded as a signal to supply primary breaking current to produce a spark for ignition.

As shown in the table 100, the ignition command signal $T_i$, $D_i$ varies among the cylinders.

In this embodiment, this ignition command signal $T_i$, $D_i$ is corrected by the operating conditions and the environmental conditions. The corrected ignition command signal is issued as an ignition command signal in the next engine cycle. Now, suppose that an ignition command signal to an arbitrary cylinder, say, the first cylinder is accessed and latched in a data register 101, that the ignition command signal is sent through an input/output device 102 to an ignition control circuit 105, and that the power transistor is controlled to cause an ignition to occur in the first cylinder. The operating condition and environmental condition of the first cylinder are detected, and correction data $d_1$, $\tau_1$ is set (step 103). By this correction data $d_1$, $\tau_1$, corrections are made in the ignition command signal for the first cylinder, which has been read out, from $T_1$ to $T_1+\tau_1$ and from $D_1$ to $D_1-d_1$ (step 104). A resulting new ignition command signal is written in the storage location at the address of the first cylinder in the table 100.

The operating conditions include the variations in the values of the inductance and the internal resistance of the ignition coils, the coil temperature and the source voltage. The variations in the inductance and the internal resistance of the ignition coils are previously, known values of each of the ignition coils, so that the data on such variations is static data, while the coil temperature and the source voltage tend to vary at every ignition cycle that is, are dynamic data. The latter data should preferably be detected before ignition.

The environmental conditions are the ambient temperature, etc. of the ignition coils. This data is represented by dynamic values, and therefore, needs to be detected when occasion demands.

A method of correcting the ignition command signal IGN will be described. It is necessary to control the ignition command signal according to the basic ignition advance characteristics. Therefore, due to changes in the operating conditions and the environmental conditions, caused by the variations in the properties of the coils and the resistance, if the ignition command signal deviates from the basic ignition advance characteristics, a correction amount $\tau_1$, $d_1$ is applied to $T_1$, $D_1$ to correct $T_1$, $D_1$ so that the ignition control is performed in compliance with the basic ignition advance characteristics. In this case, if a deviation from the basic ignition advance characteristics is detected in the current cycle, the corrected signal $T_1+\tau_1$, $D_1-d_1$ is given as an ignition command signal in the next cycle.

In the foregoing embodiment, the ignition command signal, issued to each cylinder, which varies according to the operating conditions and the environmental conditions can be put back to the fundamental form which is determined by the basic ignition advance characteristics of the ignition timing control circuit (means) even if a deviation of the signal occurs, so that optimum control of ignition in a fundamental form can be achieved.

Another embodiment of this invention will now be described. As engines are required to have higher performance and higher speed, it is necessary to control the ignition system with high accuracy.

Conventionally, in order to obtain sufficient ignition voltage and energy, the ignition current conduction time has been set so as to accommodate the performance of the lower limit product (a product requiring the longest current conduction time) of the parts of the ignition system, the ignition coils, for example. However, a problem with this type of approach is that the ignition current conduction time has to be excessive for all those parts other than the lower limit product compared with a case wherein an ignition voltage and energy suitable for the respective parts are applied. In addition, another problem with this approach is that the excessive voltage and energy are a heavy burden on the elements (in terms of heat) and adversely affect the life of the elements. As a solution to this problem, in this embodiment, the saturation value of the primary breaking current is detected indirectly, thereby implementing optimum ignition control (shortest ignition current conduction time) of the individual cylinders. By this control, the current conduction time can be made minimum but sufficient during high engine speed, namely, in the range of short ignition periods.

Figure 2:
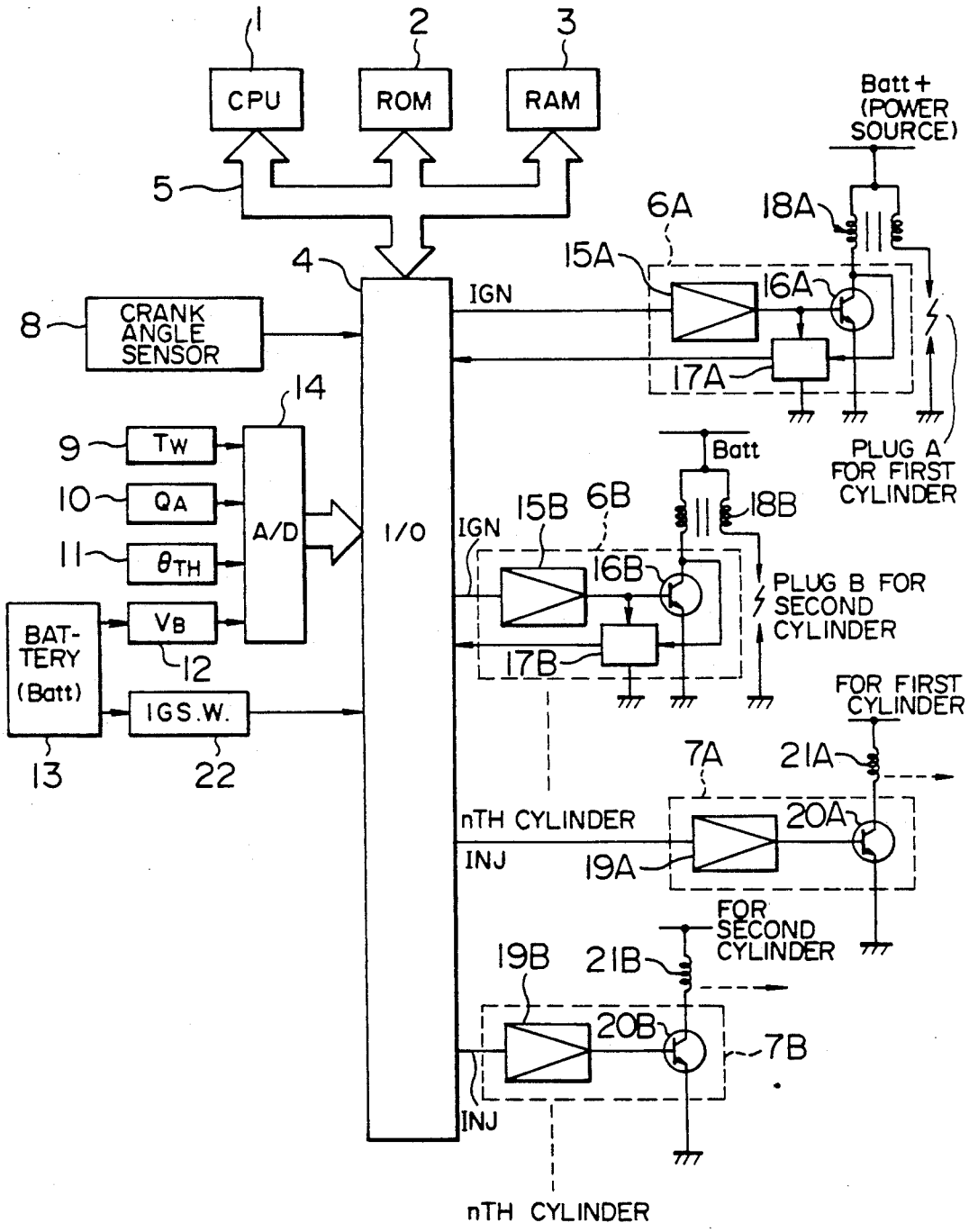
FIG. 2 is a block circuit diagram of the embodiment of this invention of FIG. 1.

FIG. 2 is a block circuit diagram of the ignition control apparatus according to the embodiment of this invention shown in FIG. 1. The engine used in the present embodiment is an engine in which each cylinder is provided with one ignition coil and one ignition plug. Note, therefore, that this engine is not structured to distribute the ignition energy to multiple cylinders by switching one ignition coil.

In accordance with the present invention, there are provided CPU1, ROM2, RAM3, input/output device 4, and a bus 5. CPU1 performs a process for ignition control and in addition to this, is capable of performing other processes such as fuel control. ROM2 stores programs for those processes. RAM3 stores various data, including work data, and programs. The input/output device 4 receives various measurement data for the above-mentioned processes and sends this data to CPU1, and also receives various control commands from CPU1 and other data and sends it to various control systems including the ignition control system.

Various detecting devices, such as a crank angle sensor 8, water temperature sensor 9, air flow sensor 10, throttle opening sensor 11, detector 12 of the voltage of a battery 13, and ignition key switch 22 are mounted on a car. Those detecting devices which are concerned with this embodiment are the crank angle sensor 8 and the water temperature sensor 9.

If the number of cylinders is N in the present embodiment, ignition coils 18A, 18B, . . . are provided. Ignition control circuits 6A, 6B, . . . are provided to control the ignition coils to turn on and off the ignition at ignition plugs A, B, . . . Injection control circuits 7A, 7B, . . . are provided to control fuel injection valve drive coils 21A, 21B, . . .

The ignition control circuits 6A, 6B have the same internal structure and comprise amplifier circuits 15A, 15B for amplifying an ignition command signal IGN, ignition time control circuits 17A, 17B, and power transistors 16A, 16B. The fuel injection control circuits 7A 7B have the same internal structure, and respectively comprise amplifier circuits 19A, 19B and power transistors 20A, 20B.

Ignition command signals IGN are command signals to turn on the power transistors 16A, 16B. To this end, the power of the ignition command signals is increased by the amplifier circuits 15A, 15B. The ignition command signal IGN has a fixed or optional pulse width, and the power transistors 16A, 16B are turned off at the trailing edge of the pulse. When the power transistors are turned off, the energy ($LI^2/2$) (where L is the inductance of the ignition coil and I is the current flowing through the ignition coil) accumulated in the ignition coils 18A, 18B is discharged all at once as ignition energy to the ignition plugs A, B.

Needless to say, the output timing of ignition command signals IGN varies with the individual cylinders.

Ignition command signals IGN are determined by the processing result produced by CPU1 (.the result of processing by the ignition timing control means and according to the above-mentioned basic ignition advance characteristics). However, in an arrangement in which ignition coils are provided for all cylinders, the characteristic variation among the ignition coils has adverse effects on the fundamental form of the ignition command signals.

As a countermeasure, ignition timing control circuits 17A, 17B are provided so that the ignition can be executed in an optimum way that is, with the shortest current conduction time for each cylinder. The ignition timing control circuits 17A, 17B detect whether or not the current conduction time to the ignition coils 18A, 18B is maximum and check how much the excess length of time is. CPU1 accepts this data through the input/output device 4, and if its finds an excess time length, generates in the next cycle, an ignition command signal IGN having a pulse width shorter than in the preceding cycle.

Specifically, if D denotes the shortest current conduction time necessary and sufficient for ignition in a given cylinder and if S denotes an excess current conduction time, the overall current conduction time T is $$T=D+S \quad (1)$$

This embodiment has as its object to cut this excess time length S. Incidentally, this excess time length is obtained from the current conduction time in the present cycle and this excess time length is removed in the same cylinder in the next cycle.

This excess time length S is known by checking changes in the operation of the power transistors 16A, 16B, for example, by checking if the power transistors 16A, 16B are put in the saturated state by current conduction. If they are in the saturated state, this is regarded as a result of excessive current conduction.

The ignition timing control circuits 17A, 17B detect whether the corresponding power transistors are saturated or not, and sends the detection results through the input/output device 4 to CPU1. CPU1 receives the data and sends an ignition command signal IGN, which has been shortened by the excess time, to the same cylinder (for example, the first cylinder when the excessive current conduction is detected by the ignition timing control circuit 17A) to control the ignition timing.

Figure 3:
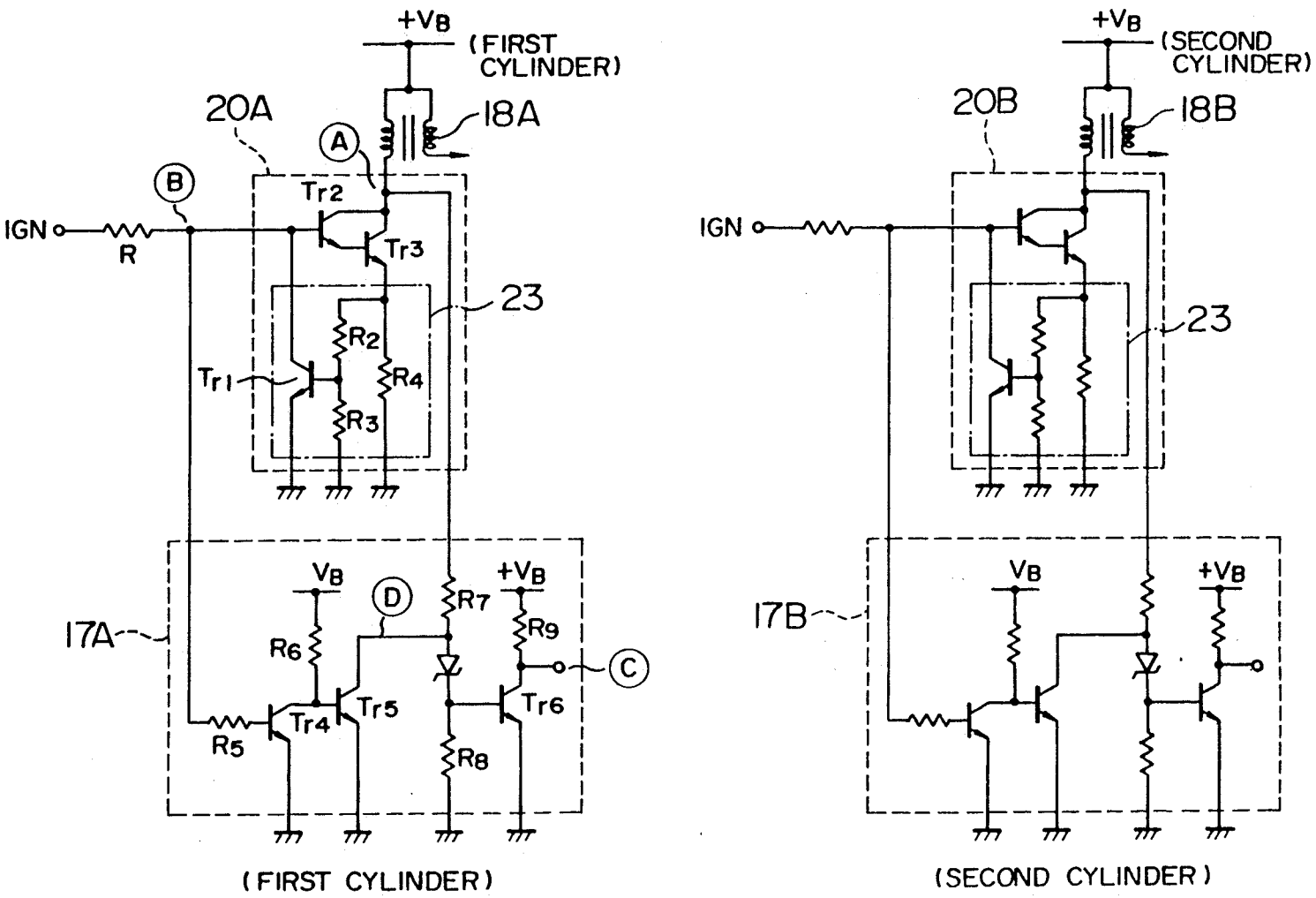
FIG. 3 is a circuit diagram showing a detail of the block circuit diagram of FIG. 2.

FIG. 3 is a diagram showing an embodiment of the ignition control apparatus. An ignition control apparatus, which has the same internal structure, is provided for each cylinder. FIG. 3 shows examples of the ignition control circuits for the first and second cylinders. With reference to the example of the first cylinder, the ignition control circuit will be described.

In FIG. 3, the ignition control circuit of the first cylinder comprises an ignition command section 20A and a current conduction time detection circuit 17A. The ignition command section 20A is a circuit including the amplifier 15A and the power transistor 16A, and these two functions are realized by transistors $Tr_2$, $Tr_3$ connected in Darlington connection. In addition, the ignition command section 20A includes a current limiting circuit 23. The current limiting circuit 23 comprises a transistor $Tr_1$, and resistances $R_2$, $R_3$, $R_4$, and performs self-control to prevent the operational current flowing through the transistors $Tr_2$, $Tr_3$ connected in Darlington connection from becoming too large.

The ignition timing control circuit 17A is a circuit for detecting an excess current conduction time length, which circuit comprises transistors $Tr_4$, $Tr_5$, $Tr_6$, a Zener diode AD, and resistances $R_5$ to $R_9$. A detection signal C of an excess current conduction time length is obtainable when the voltage is at high level (V) at point A and point D. This signal C cannot be obtained when the voltage is at low level (L) both at points A and D or at high level only at either of these two points. In other words, only when the voltage levels are high at points A and D does the ANDing produce a detection signal C.

The condition for high level at point A is when the transistors $Tr_2$, $Tr_3$ are OFF or in the saturation region. The condition for high level at point D is when an ignition command signal IGN is being applied ($Tr_4$ ON→$Tr_5$ OFF→the voltage level at point D never drops).

Therefore, a detection signal C of an excessive current conduction is produced when the transistors $Tr_2$, $Tr_3$ connected in Darlington connection are in a saturated state while an ignition command signal IGN is present.

Figures 4A, 4B, 4C, 4D:
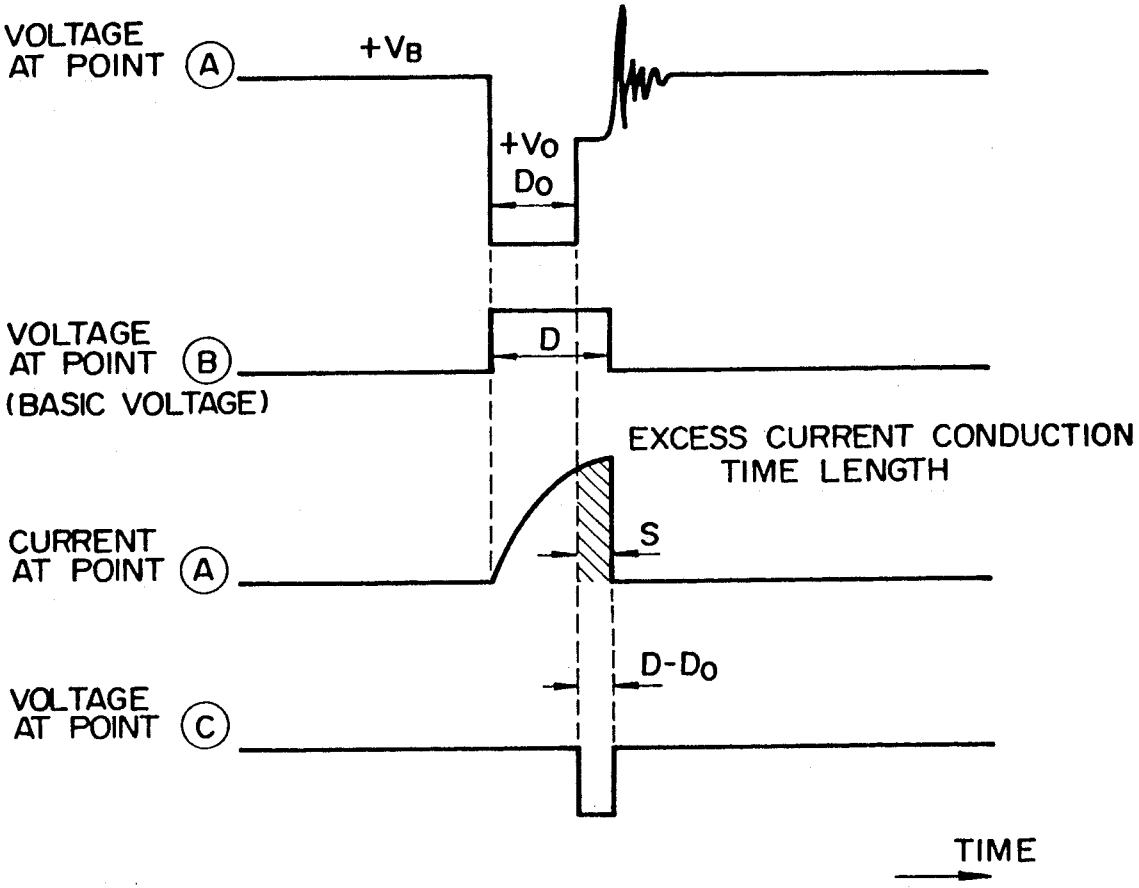
FIGS. 4A to 4D are waveform diagrams of voltages and currents in the circuit of FIG. 3.

FIGS. 4A to 4D show time charts of the embodiment of FIG. 2. A voltage corresponding to the ignition command signal IGN is applied to point B exactly reflecting the movement of the ignition command signal IGN. By this application of the voltage, the transistors $Tr_2$, $Tr_3$ connected in Darlington connection are turned ON, so that the voltages and the current (primary breaking current) appear at point A as shown in FIG. 4A.

Here, if the current conduction time length D is equal to or shorter than the adequate current conduction time length $D_0$ ($D \leqq D$), the transistors $Tr_2$, $Tr_3$ connected in Darlington connection are never saturated. However, if $D > D_0$, in a time length corresponding to the difference ($D-D_0$), $Tr_2$, $Tr_3$ are saturated.

Yet, when $Tr_2$, $Tr_3$ are saturated, the voltage at point A rises to a voltage $V_0$ (high level). On the other hand, point D has a voltage with the same phase as the voltage at point B. Therefore, ANDing of the high levels at points A and D allows excessive current conduction indicated by hatching to be detected. Thus, the voltage at point C becomes a signal representing an excess current conduction time with a length of ($D-D_0$).

This voltage at point C is input through the input/output unit 4 to CPU1, and an ignition command signal ($D-(D-D_0)$), namely, $D_0$ is produced for an ignition command signal D to the first cylinder in the next cycle.

Figure 5:
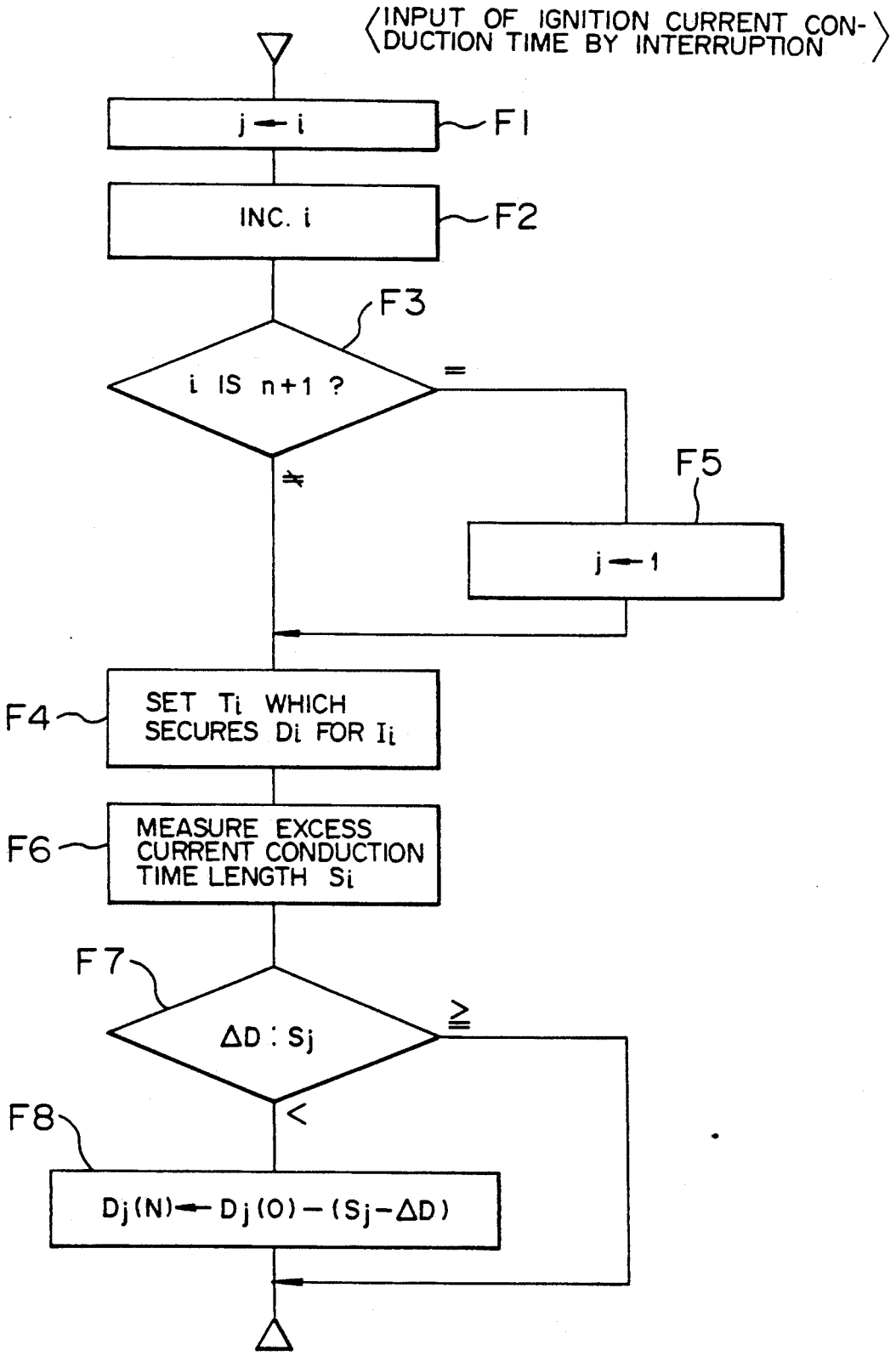
FIG. 5 is a flowchart for explaining the control of ignition current conduction time by interruption.

FIG. 5 is a diagram showing input of ignition time by interruption in the CPU1.

At step F1, i is set for j. Suppose that this i denotes a cylinder number. At step F2, i is updated. At step F3, a decision is made whether or not the cylinder number i has reached the number of all cylinders. If so, the first cylinder i=1 is set at step F5.

If the cylinder number i has not reached the total cylinder number, $T_i$ which secures $D_i$ for the primary breaking current is set at step F4. Next, an excess current conduction time length $S_j$ is measured by the circuits 17A, 17B (step F6).

At step F7, a comparison is made between an allowable time length $\Delta D$ and an excess current conduction time length $S_j$. Here, the allowable time length $\Delta D$ is a time length which is allowable in an excess current conduction time length, and also serves as a preventive time length to prevent an occurrence of an insufficient current conduction time. If $\Delta D \geqq S_j$, since $S_j$ is equal to or smaller than $\Delta D$, the current conduction time length $D_j$ need not be corrected. If $\Delta D < S_j$, since $S_j$ is larger than the allowable time length $\Delta D$, the current conduction time length $D_j$ is corrected. The correction formula shown at step F8 is used, namely, $$D_j(O)-(S_j-\Delta D)\rightarrow D_j(N) \quad (2)$$

where $D_j(O)$ is a current conduction time length when $S_j$ is measured and "O" denotes "old", $D_j(N)$ denotes a new cycle in which a correction result is reflected, that is, the subsequent cycle, and "N" denotes "new". In Eq. (2), the correction value is $(S-\Delta D)$, this value is Subtracted from $D_j(O)$, and the calculation result is made a current conduction time length $D_j(N)$ for the same cylinder at the next cycle.

In the foregoing embodiment, the update cylinder numbers do not necessarily comply with the actual cylinder numbers. This is because the order of ignition proceeds as the first cylinder→third cylinder→fourth cylinder→second cylinder→, and does not agree with the order of the cylinder numbers.

Figure 6:
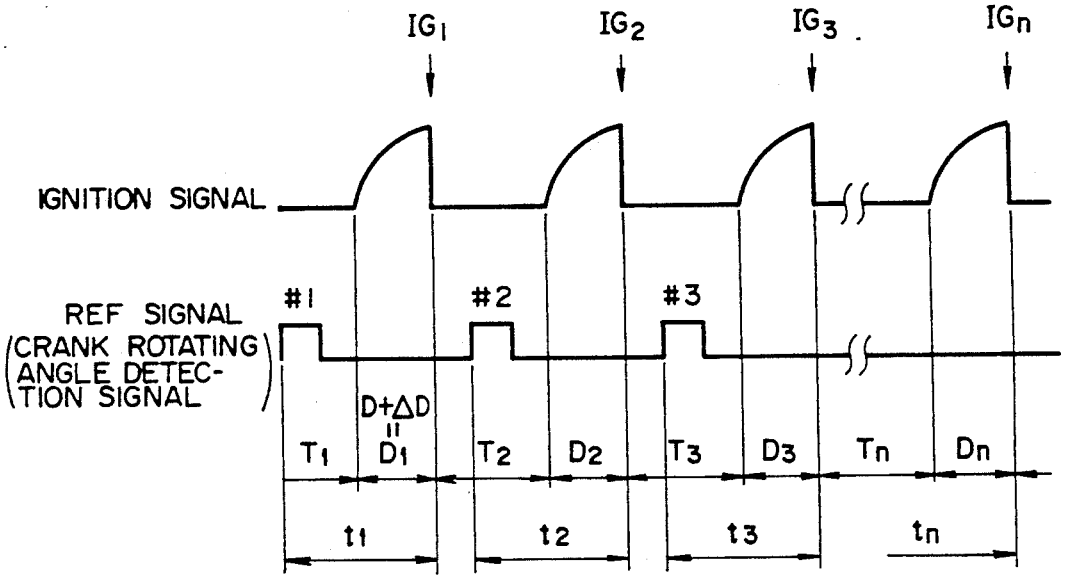
FIG. 6 is a waveform diagram for explaining the control of ignition current conduction time in a multiple cylinder engine.

FIG. 6 is an example of a time chart of reference signals and ignition signals for multiple cylinder ignition control. The reference signals REF are signals obtained from the rotation of the crankshaft. According to the order of signals (#1, #2, #3, . . . ), ignition command signals $IG_1$, $IG_2$, $IG_3$, . . . are given to the corresponding cylinder numbers #1, #2, #3, . . .

A method of issuing an ignition signal $IG_1$ is to give a time length $T_1$ from a reference signal REF (#1) till the start of current conduction and a current conduction end time $t_1$. In place of $t_1$, a current conduction time length $D_1$ may be given. Thus, the ignition command signal $IG_1$ becomes a signal which starts to rise after the elapse of time $T_1$ from the rise of the reference signal REF (#1) and falls at time $t_1$. This ignition command signal is an operational current of transistors $Tr_2$, $Tr_3$ connected in Darlington connection. The above-mentioned arrangement applies to the other cylinders #2, #3, . . .

What is important here is that $t_1$, $t_2$, $t_3$, . . . are values which are set for the fundamental timing for ignition control, and which are not subject to change in correcting set values in this embodiment. The only item subject to correction is the rising time of the ignition signal. This concept can be applied to the embodiment of FIG. 1.

Figure 7:
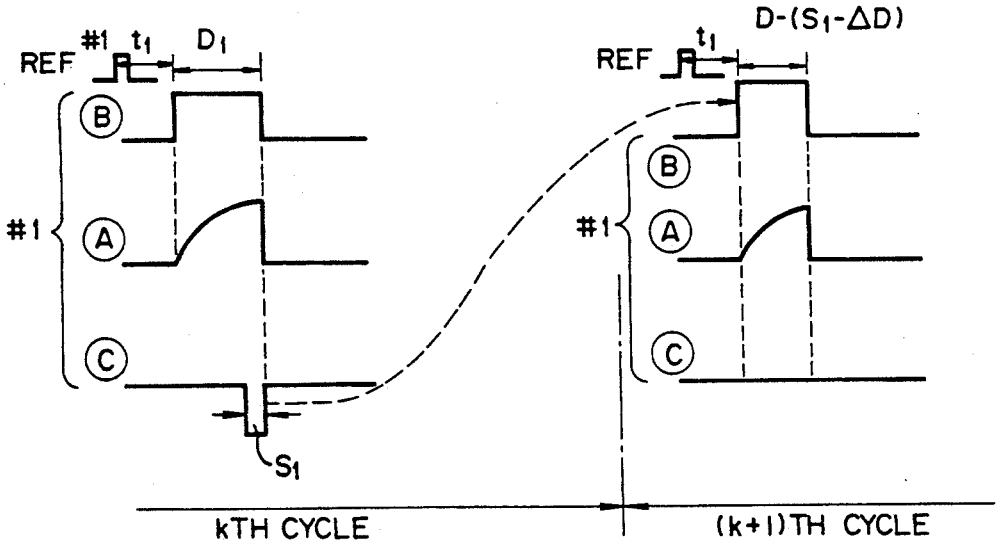
FIG. 7 is a waveform diagram for explaining the detection of excessive current conduction.

FIG. 7 is a diagram showing the detection of excessive current conduction and the timing of its application.

In this case, the kth cycle and (k+1)th cycle are taken up for discussion. FIG. 7 shows a case in which $S_1$ is detected at the first cylinder #1 in the kth cycle, and $D_1-(S_1-\Delta D)$ are set for $D_1$ in the next (k+1)th cycle. In FIG. 7, we assume that $S_1$ does not occur in the (k+1)th cycle. Also, we assume that the fundamental ignition timing has the same time length $t_1$ in the kth and (k+1)th cycles. Needless to say, even when fundamental ignition control is performed, ignition timing may sometimes differ in different cycles. Even if this is the case, such different timing is not changed.

Figure 8A:
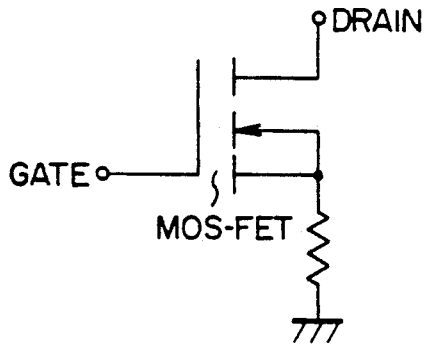
FIGS. 8A and 8B are circuit diagrams for showing another embodiment of the ignition command sections in the embodiments of this invention.
Figure 8B:
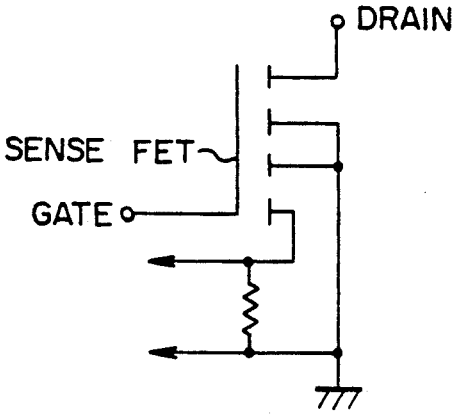

In the foregoing embodiments, bipolar transistors are supposed to be used for the power transistors as illustrated. However, power MOS-FETs or IGBTs (insulated gate bipolar transistors) may be used. Sense FETs may be substituted for the ignition command sections including the current control circuits. FIG. 8A shows an example of a power MOS-FET, and FIG. 8B shows an example of a sense FET. Among them, the sense FET has an advantage that it can reduce the loss of an overcurrent detection circuit.

In the above-mentioned embodiments, examples are shown in which the one plug/one coil arrangement, or more particularly, the one plug/one coil/one power transistor arrangement has been introduced. However, this invention can be applied to an arrangement in which one power transistor is used to energize two ignition coils. In addition, this invention can be applied to a simultaneous ignition system for emitting a spark for ignition in two cylinders by one power transistor.

As has been described, according to the embodiments, optimum ignition control can be performed for each cylinder or for each power transistor.

There is another possible method of reducing the above-mentioned excess current conduction time length $S_j$. This method is to reduce current conduction time at the rate of a reduction coefficient $\alpha(\alpha>1)$ when the integrated value of excess ignition time $S_j$ exceeds a certain limit value (value for judgment). This method can be expressed by the following formula.

If $\int_0^T S_j dt > L$, the current conduction time length is obtained as $$D_j+S_j-\alpha\int_0^T S_j dt$$

In the above-mentioned embodiments, the saturation value of the primary breaking current is detected indirectly, but can be detected directly. This method is to render a decision of excessive current conduction if a certain value is exceeded in the graph of FIG. 4C while constant detection is performed about the current value at point A.

According to this invention, optimum ignition control (shortest ignition current conduction) can be performed for each cylinder or power transistor. Therefore, the characteristics (generated voltage, etc.) of the ignition system are not affected by the characteristic variation among the ignition coils, for example. As a result, pains to adjust the ignition coils can be alleviated.

Since the primary breaking current saturation range can be minimized, the burden (or damage) to the power transistors can be reduced to a minimum.

We claim:

1. An ignition current conduction time control apparatus for an internal combustion engine, comprising:

a crank reference position detector for detecting a crank rotating position of the engine;

means for obtaining ignition timing and ignition current conduction time from a detection signal rom said detector;

power transistors corresponding to cylinders;

means for applying ignition command signals, including signals specifying said ignition timing and said ignition current conduction time, to corresponding power transistors;

ignition coils corresponding to the cylinders, each provided on the output sides of said power transistors, for accumulating ignition energy during the ON period by said ignition command signals;

ignition plugs corresponding to the cylinders for receiving accumulated energy when a current applied to said ignition coils is cut off; and control means for controlling ignition current conduction time as specified by said ignition command signals to be applied to said power transistors according to at least one of variations in values of the inductance of said ignition coil, the internal resistance of said ignition coils, coil temperature, source voltage and the ambient temperature to prevent excess current conduction of the power transistors.

2. A control apparatus according to claim 1, wherein a start time of ignition current conduction time is supplied by said control means as a means of controlling current conduction time.

3. A control apparatus according to claim 1, wherein each ignition plug is provided with one ignition coil.

4. An ignition current conduction control apparatus for an internal combustion engine, comprising:

a crank reference position detector for detecting a crank rotating position of the engine;

means for obtaining ignition timing and ignition current conduction time from a detection signal from said detector;

power transistors corresponding to cylinders;

means for applying ignition command signals, including signals specifying said ignition timing and said ignition current conduction time, to corresponding power transistors;

ignition coils corresponding to the cylinders, each provided on the output sides of said power transistors, for accumulating ignition energy during the ON period by said ignition command signals;

ignition plugs corresponding to the cylinders for receiving accumulated energy when a current applied to said ignition coils is cut off;

detecting means for detecting a saturated state of said power transistors when ignition command signals are applied to said power transistors, and time reduction control means for reducing the ignition current conduction time to said power transistors by the length of time corresponding to said saturated state.

5. A control apparatus according to claim 4, wherein said current conduction time reduction is done by delaying a start time of the current conduction time.

6. A control apparatus according to claim 4, said current conduction time reduction is done with the minimum current conduction time as a limit thereof.

7. A control apparatus according to claim 6, said current conduction time reduction with said minimum current conduction time specified as the limit thereof is done based on an integrated value of a time length of said saturated state.

8. A control apparatus according to claim 4, wherein said ignition plug of each cylinder is provided with said ignition coil.

9. A control apparatus according to claim 4, wherein said ignition plug of each cylinder is provided with a piece each of said ignition coil, said ignition plug, and said power transistor.

10. An ignition current conduction time control apparatus for an internal combustion engine, comprising:

a crank reference position detector for detecting a crank angle position of the engine;

means for determining ignition timing and ignition current conduction time using a detection signal received from said detector;

power transistors corresponding to respective cylinders;

means for applying ignition command signals, representing said ignition timing and said ignition current conduction time, to respective power transistors;

ignition coils corresponding to respective cylinders, each connected to the output of a respective one of said power transistors, for accumulating ignition energy during the ON period of said power transistors in response to said ignition command signals, ignition plugs corresponding to the respective cylinders for receiving accumulated energy when a current applied to said ignition coils is cut off; and means for eliminating the saturated state of said power transistors by controlling the start time of current conduction of said ignition command signals applied to said power transistors according to internal resistance values of said ignition coils.

* * * * *